US012638239B2

(12) United States Patent
Tranier et al.

(10) Patent No.: US 12,638,239 B2
(45) Date of Patent: May 26, 2026

(54) METHOD FOR SEPARATING AIR BY CRYOGENIC DISTILLATION

(71) Applicant: L'Air Liquide, Societe Anonyme pour l'Etude et l'Exploitation des Procedes Georges Claude, Paris (FR)

(72) Inventors: Jean-Pierre Tranier, Les Loges en Josas (FR); Maxime Rozieres, Champigny sur Marne (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 271 days.

(21) Appl. No.: 18/268,961

(22) PCT Filed: Dec. 15, 2021

(86) PCT No.: PCT/EP2021/085952
§ 371 (c)(1),
(2) Date: Jun. 21, 2023

(87) PCT Pub. No.: WO2022/136060
PCT Pub. Date: Jun. 30, 2022

(65) Prior Publication Data

US 2024/0044578 A1 Feb. 8, 2024

(30) Foreign Application Priority Data

Dec. 22, 2020 (FR) ..... 2013881

(51) Int. Cl.
*F25J 3/04* (2006.01)

(52) U.S. Cl.
CPC ..... *F25J 3/04715* (2013.01); *F25J 3/04284* (2013.01); *F25J 3/04321* (2013.01);
(Continued)

(58) Field of Classification Search
CPC .... F25J 3/14715; F25J 3/04393; F25J 3/0469; F25J 3/04066; F25J 3/0423;
(Continued)

(56) References Cited

U.S. PATENT DOCUMENTS 5,305,611 A * 4/1994 Howard ..... F25J 3/04412 62/651
5,469,710 A * 11/1995 Howard ..... F25J 3/04206 62/646
(Continued)

FOREIGN PATENT DOCUMENTS

GB 1 523 434 8/1978
JP 2007192466 A * 8/2007 ..... F25J 3/04818

OTHER PUBLICATIONS

International Search Report and Written Report for PCT/EP2021/085952, mailed Apr. 5, 2022.
French Search Report for FR 2 013 881, mailed Aug. 30, 2021.
Chakravarthy, et al., "Developments in Falling Film Type (Downflow) Reboilers in the Air Separation Industry," vol. P6, ECI Symposium Series, Sep. 1, 2005, pp. 264-272, Proceedings of Fifth International conference on Enhanced, Compact and Ultra-compact Heat Exchangers: Science, Engineering and Technology.

*Primary Examiner* — John F Pettitt, III
(74) *Attorney, Agent, or Firm* — Justin K. Murray

(57) ABSTRACT

A method for separating air by cryogenic distillation is provided, in which, at least one portion of the first oxygen-enriched liquid is sent from a first column to a first vaporizer-condenser where it is partially vaporized in the form of a film at a pressure higher than the second pressure forming a second oxygen-enriched liquid constituting at least 30% of the oxygen-enriched liquid sent to the first vaporizer-condenser and a third oxygen-enriched gas, an argon-enriched fluid is sent from a second column to a third column and the fluid is separated in the column forming an argon-rich flow at the top of the column and an oxygen-rich flow at the bottom of the column and the third oxygen-enriched gas is expanded in a turbine with production of work.

10 Claims, 1 Drawing Sheet

(52) U.S. Cl.
CPC ..... *F25J 3/04672* (2013.01); *F25J 3/04678* (2013.01); *F25J 3/0423* (2013.01); *F25J 3/04412* (2013.01); *F25J 2200/06* (2013.01); *F25J 2215/50* (2013.01); *F25J 2215/58* (2013.01); *F25J 2240/22* (2013.01); *F25J 2250/04* (2013.01); *F25J 2270/50* (2013.01); *F25J 2290/12* (2013.01)

(58) Field of Classification Search
CPC ..... F25J 3/04284; F25J 3/04678; F25J 3/04412; F25J 3/04303; F25J 3/04381; F25J 2250/04; F25J 2270/50; F25J 2215/58; F25J 2200/06; F25J 2245/58; F25J 3/04672; F25J 3/04321; F25J 3/04709
See application file for complete search history.

(56) References Cited

U.S. PATENT DOCUMENTS

| | | | | | |
|---|---|---|---|---|---|
| 5,590,544 | A * | 1/1997 | Corduan | F25J 3/04884 | 62/656 |
| 5,868,199 | A | 2/1999 | Lavin | | |
| 5,887,447 | A | 3/1999 | Higginbotham | | |
| 5,934,105 | A * | 8/1999 | Bonaquist | F25J 3/04024 | 62/646 |
| 2002/0178747 | A1 | 12/2002 | Pompl | | |
| 2015/0121955 | A1 | 5/2015 | Davidian et al. | | |
| 2023/0358468 | A1 * | 11/2023 | Golubev | F25J 3/04096 | |

* cited by examiner

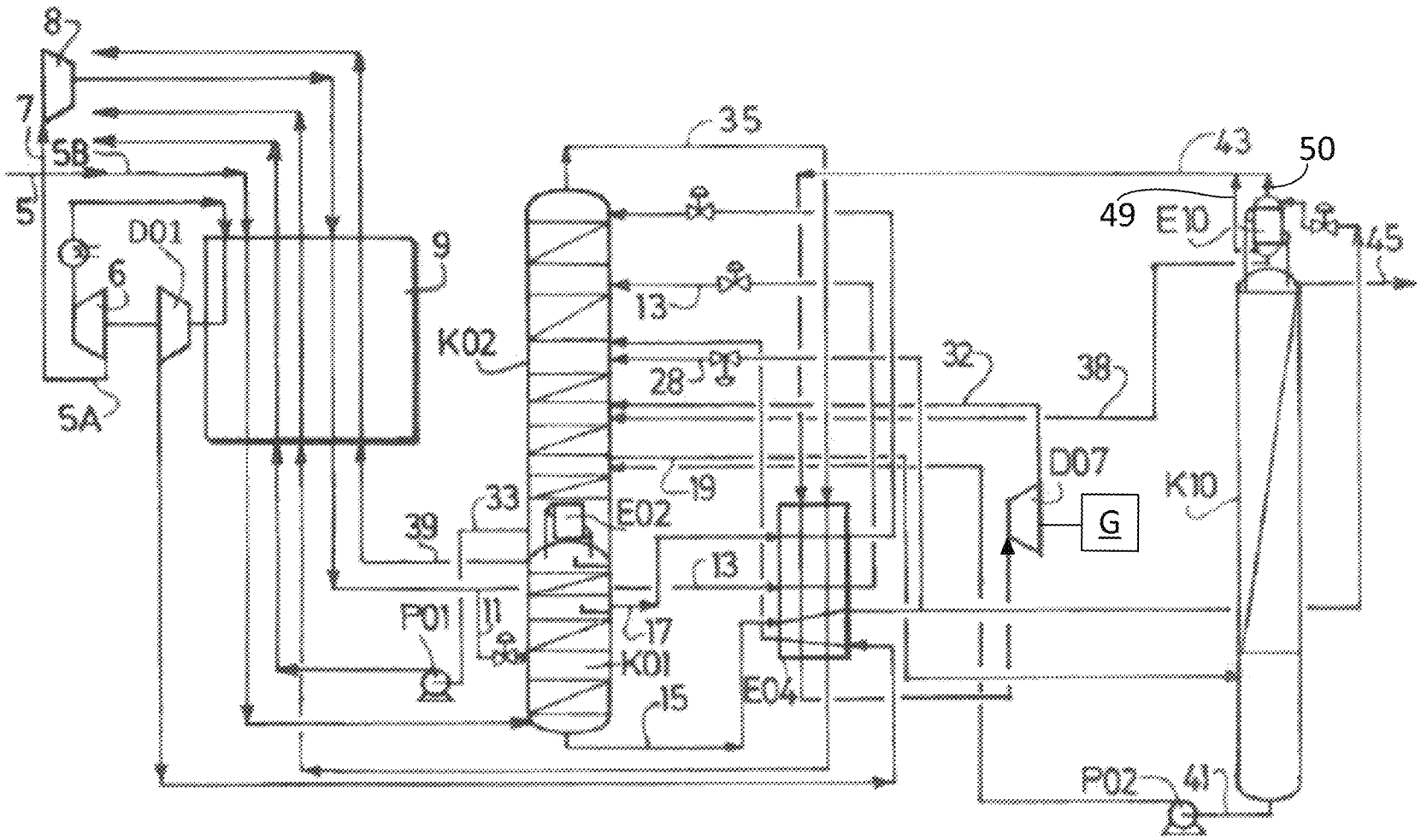
45
50
43
49
E10
K10
41
P02
38
D07
G
32
35
E04
13
28
19
E02
17
K01
15
K02
33
39
P01
9
D01
6
5A
8
7
5
58

METHOD FOR SEPARATING AIR BY CRYOGENIC DISTILLATION

CROSS REFERENCE TO RELATED APPLICATIONS

This application is a § 371 of International PCT Application PCT/EP2021/085952, filed Dec. 15, 2021, which claims the benefit of FR2013881, filed Dec. 22, 2020, both of which are herein incorporated by reference in their entireties.

FIELD OF THE INVENTION

The present invention relates to a method for separating air by cryogenic distillation, with or without argon production.

BACKGROUND OF THE INVENTION

It is well known to separate air in an arrangement composed of a first column K01 operating at a first pressure K01, a second column K02 operating at a second pressure lower than the first pressure, and a column for producing argon K10.

In this case, the cold is generally produced by expanding the air or nitrogen in a turbine.

A known method according to the prior art is found in U.S. Pat. No. 5,469,710.

U.S. Pat. No. 5,868,199 describes a similar method but with a film vaporizer used as a dephlegmator with the gas circulating counter-current to the oxygen-rich, thus substantially pure, liquid in the double column of an air separation apparatus.

SUMMARY OF THE INVENTION

In certain embodiments of the invention, it is an aim to propose a method for separating air, which is particularly efficient in energy terms. Indeed, the use of a co-current heat exchanger enables the pressure of the vaporized oxygen-enriched liquid to be maximized. The liquid at the outlet of a co-current exchanger is less oxygen-enriched than in the case of a counter-current exchanger. In general, the liquid according to the invention contains 53% oxygen instead of 59% for the counter-current case. It is therefore possible to vaporize at a higher pressure for a given condensation temperature. This advantage is only applicable if an impure fluid is vaporized, as in the case of a condenser at the top of an argon column.

Another aim of the invention is to propose a method that is particularly safe. Indeed, co-current exchangers present less safety risk than counter-current exchangers, precisely because the oxygen enrichment is lower.

According to one object of the invention, a method is provided for separating air by cryogenic distillation, in which i) a flow of compressed, purified and cooled air is sent to a first column operating under a first pressure, where it separates forming a first oxygen-enriched liquid and a first nitrogen-enriched flow;

ii) at least one portion of the first oxygen-enriched liquid is sent to a first vaporizer-condenser, where it is partially vaporized at a pressure higher than a second pressure, forming a second oxygen-enriched liquid and a third oxygen-enriched gas;

iii) at least one portion of the first nitrogen-enriched flow is sent to a second column operating under the second pressure, lower than the first pressure;

iv) the bottom of the second column is heated by means of a second bottom vaporizer-condenser;

v) an argon-enriched fluid is sent from the second column to a third column and the fluid separates in the third column forming an argon-rich flow at the top of the column and an oxygen-rich flow at the bottom of the column;

vi) the argon-rich flow condenses in the first vaporizer-condenser; and vii) the third oxygen-enriched gas is expanded in a turbine with production of work, optionally after heating, characterized in that the at least one portion of the first oxygen-enriched liquid partially vaporizes in the first vaporizer-condenser in the form of a film, the third gas exiting via the bottom of the first vaporizer-condenser co-current with the liquid which vaporizes and the second oxygen-enriched liquid constitutes at least 30% of the oxygen-enriched liquid sent to the first vaporizer-condenser.

According to other optional aspects:

the temperature difference between the oxygen-enriched liquid and the temperature of the liquid exiting at the bottom of the condensation side of the first vaporizer-condenser is lower than 1° C., preferably lower than 0.5° C.;

the turbine drives a booster on the gaseous fluids of the method;

the gaseous fluid is the residual gas used for the regeneration of the purification at the top;

the turbine drives a generator;

the generator turns at the same speed as the turbine;

the energy of the generator passes into a frequency converter for supplying the electrical grid at 50 or 60 Hz depending on the country;

the turbine drives a booster and a generator, the three on the same shaft, turning at the same speed;

the gas to be expanded is heated by indirect heat exchange with a liquid coming from the first column or from the main exchanger which sub-cools;

the first vaporizer-condenser is both a condenser at the top of the third column and a condenser of a portion of the argon-enriched fluid or of an argon-enriched fluid taken at an intermediate level in the third column;

the first vaporizer-condenser is not a condenser at the top of the third column and, in the first vaporizer-condenser, a portion of the argon-enriched fluid or an argon-enriched fluid taken at the intermediate level in the third column is condensed;

the portion of the argon-enriched fluid or of the argon-enriched fluid taken at an intermediate level in the third column is introduced at an intermediate level of the third column;

the second oxygen-enriched liquid is sent to vaporize in a condenser at the top of the third column by heat exchange with the gas at the top of the third column;

the first vaporizer-condenser is a condenser at the top of the third column, and the argon-rich gas at the top of the third column is condensed in the first vaporizer-condenser;

the argon-rich flow is mixed with the residual fluid of the second column;

the gas to be expanded is not heated in a main exchanger where the supply air is cooled upstream of the expansion;

the gas to be expanded is at between 1.7 and 2.7 bar absolute.

BRIEF DESCRIPTION OF THE DRAWINGS

These and other features, aspects, and advantages of the present invention will become better understood with regard to the following description, claims, and accompanying drawing(s). It is to be noted, however, that the drawing(s) illustrate only several embodiments of the invention and are therefore not to be considered limiting of the invention's scope as it can admit to other equally effective embodiments.

The FIGURE shows a process diagram for the method according to the invention.

DETAILED DESCRIPTION OF THE INVENTION

The FIGURE shows a three column apparatus, including a first column K01 operating at a first pressure K01, a second column K02 operating at a second pressure lower than the first pressure, and a column for producing argon K10. The first column K01 is thermally connected to the second column K02 by the bottom condenser E02 of the second column K02 in known manner.

A flow of air is compressed by a compressor (not shown) to the high pressure, the compressed flow is purified in a purification unit (not shown) and the purified flow is divided into two. The major portion of the air 5 is again separated into two in order to form two flows 5A and 5B. Flow 5A is boosted in a booster 6 coupled to a turbine D01. The air 5A is then cooled in a cooler D01 E, partially cools in the exchange line 9 and is sent to the turbine D01. The expanded air is sent to the second column K02.

The air 5B is sent to the exchange line 9 where it cools before being sent, in gaseous form, to the bottom of the first column K01.

The remainder of the air 7 is boosted in a booster 8 to a high pressure. After being cooled in the exchange line 9, the flow is divided in two, one portion 11 being sent to the first column K01 and the remainder 13 to the second column K02 after sub-cooling in E04, both in liquid form.

Other ways of cooling the air and generating cold can replace these.

A nitrogen-rich liquid 13 is cooled in the sub-cooler E04 and supplies the second column K02.

A flow of rich liquid 15 (oxygen-enriched liquid) is withdrawn at the bottom of the first column K01. A portion of the rich liquid supplies a top condenser E10 of the argon column K10. The condenser-vaporizer E10 is used to condense the gas at the top of the argon column K10.

The rich liquid 15 is partially vaporized in the film vaporizer E10 in the form of a film, in order to form an oxygen-enriched liquid and an oxygen-enriched gas. The vaporized gas 49 exits via the bottom of the condenser-vaporizer E10 co-current with the liquid which vaporizes; only the instantaneously vaporized gas 50 coming from the incoming liquid exits at the top. Indeed, the expansion in the valve just upstream of the vaporizer E10 generates the gas at the inlet of the condenser vaporizer which can represent up to 10% of the liquid 45. The condenser-vaporizer E10 is shown without a housing (cylindrical shell) around it: this signifies that one (or more) brazed aluminum plate heat exchangers are used where hemispherical ends have been welded to the upper and lower ends in order to supply liquid and to recover and separate the gaseous and liquid fractions at the bottom. This condenser-vaporizer E10 could also be placed in a housing.

In this example, the gas at the top of the hemispherical end at the lower end of the condenser-vaporizer E10 joins the gas generated upstream of the condenser-vaporizer E10 taken from inside the hemispherical end at the upper end of the condenser-vaporizer, and the liquid withdrawn at the bottom of the hemispherical end is sent to the column K02.

The gas exiting via the bottom of the first vaporizer-condenser, co-current with the liquid which vaporizes, is of order 50% of the liquid 45.

The oxygen-enriched liquid 38 constitutes at least 30% of the liquid 15 sent to the vaporizer E10. Hence, the condenser-vaporizer E10 is massively purged: this reduces the oxygen concentration of the vaporized fluid and therefore increases the vaporization pressure for a given temperature.

The temperature difference between the oxygen-enriched liquid 38 and the temperature of the liquid exiting the bottom, condensation-side, of the condenser E10 is lower than 1° C., preferably lower than 0.5° C.

The liquid 38 is sent to the second column K02 and the gas 43 is heated in the sub-cooler E04 before being expanded in a turbine D07 and then sent as gas 32 to supply the second column K02. Is not absolutely necessary to heat the vaporized liquid 43 coming from the vaporizer E10. It could also be sent directly to the turbine D07, but a two-phase flow would be produced which would need to be managed. If the turbine is on the ground, this requires a separator pot and pump on the liquid fraction; otherwise, the turbine can be sited above the point of injection of the gas 32 into the second column K02 so that the liquid flows with a downward gradient. In this case, a turbine without oiled bearings, in other words with magnetic bearings or rolling bearings or gas bearings, will be used.

The inlet pressure of the turbine D07 is between 1.7 and 1.9 bar absolute and the second pressure is of order 1.4 bar absolute.

The remainder 28 of the rich liquid 15 is optionally sent to the second column K02. In the majority of cases, it is preferred to send all of the rich liquid to the vaporizer-condenser E10.

A nitrogen-rich gas flow 39 is withdrawn at the top of the first column K01 as product.

A nitrogen-rich gas flow 35 is withdrawn at the top of the second column K02, heats up in the sub-cooler and in the exchanger 9.

A liquid oxygen flow 33 is withdrawn at the bottom of the second column K02, pressurized by the pump P01 and then vaporizes in the exchange line 9.

The argon column K10 is supplied at the bottom by an argon-enriched flow 19 coming from the column K02.

The liquid from the bottom of the argon column 41 is relatively pure oxygen which is pumped in a pump P02, and returned at the bottom of the second column K02.

An argon flow is withdrawn as product at the top of the column K10. The argon production is not essential.

It is obviously conceivable to vaporize other liquids in the exchange line.

The turbine D07 can drive a booster on one of the gaseous fluids of the method.

This gaseous fluid may be the residual gas used for the regeneration of the purification at the top.

The turbine can drive a generator.

The generator can turn at the same speed as the turbine.

The energy from the generator can pass into a frequency converter in order to supply the electrical grid at 50 or 60 Hz depending on the country.

The turbine can drive a booster and a generator, the three being on the same shaft, turning at the same speed.

The gas 43 is heated by sub-cooling a liquid 28 coming from the first column K01 or from the main exchanger E01.

A portion of the argon-enriched fluid 19 can be condensed in the first vaporizer-condenser (E10).

The condensed portion of the fluid 19 will then be introduced into the third column K10 at an intermediate level thereof.

The argon-rich flow 45 can be mixed with the residual fluid 35 of the second column K02. In this case, there is no argon production.

The second column K02 can contain the vaporizer E10 and/or the column K10. The second column K02 can support the vaporizer E10.

In any event, the argon produced by the column K10 is not necessarily a product of the apparatus and can be mixed with the residual nitrogen and sent to the atmosphere.

Alternatively, the liquid sent to the vaporizer-condenser E10 could be partially or totally liquid air 11 or 13 which has come from the compressor 8.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed.

Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A method for separating air by cryogenic distillation, in which:

i) a flow of air, which is compressed, purified and cooled, is sent to a first column operating under a first pressure where the flow of air separates forming a first oxygen-enriched liquid and a first nitrogen-enriched flow;

ii) at least one portion of the first oxygen-enriched liquid is sent to a first vaporizer-condenser where the first oxygen-enriched liquid is partially vaporized at a pressure higher than a second pressure, thereby forming a second oxygen-enriched liquid and a third oxygen-enriched gas;

iii) at least one portion of the first nitrogen-enriched flow is sent to a second column operating under the second pressure, lower than the first pressure;

iv) a bottom of the second column is heated by a second bottom vaporizer-condenser;

v) an argon-enriched fluid is sent from the second column to a third column and the argon-enriched fluid separates in the third column forming an argon-rich flow at a top of the third column and an oxygen-rich flow at a bottom of the third column;

vi) the argon-rich flow condenses in the first vaporizer-condenser; and vii) the third oxygen-enriched gas is expanded in a turbine with production of work, optionally after heating, wherein the at least one portion of the first oxygen-enriched liquid that partially vaporizes in the first vaporizer-condenser is in the form of a film, wherein flow within the first vaporizer-condenser is co-current such that the second oxygen-enriched liquid and a portion of the third oxygen-enriched gas exit a lower portion of the first vaporizer-condenser, and the second oxygen-enriched liquid constitutes at least 30% of the at least one portion of the first oxygen-enriched liquid sent to the first vaporizer-condenser.

2. The method as claimed in claim 1, wherein a temperature difference between the second oxygen-enriched liquid and a temperature of a condensed argon-rich liquid exiting at a bottom of a condensation side of the first vaporizer-condenser is lower than 1° C.

3. The method as claimed in claim 1, wherein the turbine drives a generator.

4. The method as claimed in claim 3, wherein the generator turns at the same speed as the turbine.

5. The method as claimed in claim 4, wherein energy from the generator passes into a frequency converter in order to supply an electrical grid at 50 or 60 Hz depending on the country.

6. The method as claimed in claim 1, wherein the third oxygen-enriched gas is heated by indirect heat exchange with a liquid coming from the first column which sub-cools the liquid coming from the first column.

7. The method as claimed in claim 1, wherein the third oxygen-enriched gas is not heated in a main exchanger.

8. The method as claimed in claim 1, wherein the third oxygen-enriched gas is at between 1.7 and 2.7 bar absolute prior to being expanded in the turbine.

9. The method as claimed in claim 1, wherein all the first oxygen-enriched liquid is sent to the first vaporizer-condenser.

10. The method as claimed in claim 6, wherein the liquid coming from the first column is selected from the group consisting of a nitrogen-rich liquid, the first oxygen-enriched liquid, and combinations thereof.

* * * * *